US005165871A

United States Patent [19]

Iwabuchi

[11] Patent Number: 5,165,871

[45] Date of Patent: Nov. 24, 1992

[54] ELECTROMAGNETIC PUMP

[75] Inventor: Hideo Iwabuchi, Saitama, Japan

[73] Assignee: Jidosha Kiki Co., Ltd., Tokyo, Japan

[21] Appl. No.: 694,828

[22] Filed: May 2, 1991

[30] Foreign Application Priority Data

May 10, 1990 [JP] Japan ..... 2-48142[U]

[51] Int. Cl.[5] ..... F04B 17/04

[52] U.S. Cl. ..... 417/417; 310/91

[58] Field of Search ..... 417/417, 418; 310/91, 310/17

[56] References Cited

U.S. PATENT DOCUMENTS

| | | | |
|---|---|---|---|
| 3,404,299 | 10/1968 | MacBlane | 310/17 |
| 4,299,544 | 11/1981 | Masaka | 417/417 |
| 4,643,653 | 2/1987 | Masaka | 417/417 |
| 4,661,048 | 4/1987 | Masaka | 417/417 |
| 4,778,357 | 10/1988 | Arai | 417/417 |
| 4,895,495 | 1/1990 | Arai | 417/417 |
| 4,934,041 | 6/1990 | Hoover | 310/91 |

*Primary Examiner*—John J. Vrablik
*Assistant Examiner*—Peter Korytnyk
*Attorney, Agent, or Firm*—Blakely, Sokoloff, Taylor & Zafman

[57] ABSTRACT

An electromagnetic pump includes a sleeve member, a resin coil bobbin, a ring-like printed circuit board, a ring-like holder, a plurality of studs, a pump housing, and a projecting portion. The sleeve member houses a plunger for controlling an operation of a control valve. The coil bobbin is arranged around the sleeve member, has a pair of flanges, and winds an excitation coil. The printed circuit board is stacked on the outer surface side of one flange of the coil bobbin with a predetermined interval therebetween and has a surface which faces the coil bobbin and on which various types of electronic parts are mounted. The holder is stacked on the side of the printed circuit board opposite to the coil bobbin with a predetermined interval therebetween. The studs project from the outer surface of the one flange of the coil bobbin and an inner surface of the holder and integrally form a stacked body. The pump housing houses the stacked body integrally formed by the studs and the sleeve member in as assembled state. The projecting portion projects from a predetermined position on the outer surface of the one flange of the coil bobbin to apply an urging force to the various types of electronic parts mounted on the printed circuit board.

2 Claims, 2 Drawing Sheets

ELECTROMAGNETIC PUMP

BACKGROUND OF THE INVENTION

The present invention relates to an improvement in an electromagnetic pump for, e.g., fuel supply of an automobile.

An electromagnetic pump to be used as an automobile fuel supply pump or the like is desired to have a simple structure not requiring high part machining and assembly accuracies and to stably perform a pump operation.

Conventionally, the present inventors have proposed, in, e.g., Japanese Utility Model Laid-Open Nos. 61-70581, 61-76172, and 1-99981, a portable electromagnetic pump in which the arrangement of an individual portion is simplified to decrease the number of constituting parts, the reliability in machining, assembly, and operation of each portion is improved, and the entire pump can be made small in size and light in weight at low cost. That is, in this portable electromagnetic pump, a pump housing is constituted by a substantially cup-like housing main body and a cover member for closing the opening end of the housing main body. A resin coil bobbin for winding an excitation coil arranged around a sleeve member for housing a plunger, a printed circuit board stacked outside one flange of the bobbin with a predetermined interval therebetween to mount various types of electronic parts including a transistor, and a holder stacked outside the printed circuit board with a predetermined interval therebetween are sequentially stacked and housed in the pump housing and biased against the cover member by a biasing means such as a leaf spring provided on the housing main body bottom portion side. As a result, variations in dimensions between the housed members are absorbed to realize a stable assembly state.

In the above conventional structure, the transistor arranged close to the printed circuit board is mounted on the circuit board while being inserted together with a heat radiation plate into a stud formed on the coil bobbin and is held by setting the holder. Various types of electronic parts such as a surge absorber mounted on the circuit board are laterally assembled on the circuit board and fixed by soldering or the like with their lead portions being bent. In this conventional structure, however, the assembly of circuit parts is cumbersome and complex and requires a long assembly time. Therefore, this structure is still unsatisfactory to realize a low manufacturing cost. In particular, the assembly operations of each pump portion including the assembly of a circuit part of this type onto the circuit board are desired to be automated as much as possible.

Another problem of the above conventional structure is a mounting efficiency of mounting the circuit parts described above onto the circuit board. That is, in the conventional structure, upon assembly of the circuit parts onto the circuit board, these circuit parts are laterally arranged on the circuit board with their lead wires being bent so as to minimize the mounting space on the printed circuit board, thereby decreasing the size of the pump. This assembly state, however, poses a problems in terms of assembly efficiency and does not efficiently use the mounting surface of the circuit board. In consideration of the fact that to increase the length of a lead wire to mount each part on the circuit board poses a problem in assembly space or a vibration resistance, a lead wire having a minimum length may be vertically inserted into the circuit board to mount a circuit part. In this case, however, in accordance with the type of circuit part, a lead insertion hole formed in the circuit board is closed to disable degassing upon soldering, thereby, easily leading to a connection failure. Also, this assembly is still unsatisfactory in terms of a vibration resistance.

SUMMARY OF THE INVENTION

It is an object of the present invention to provide an electromagnetic pump which can be automatically assembled.

It is another object of the present invention to provide an electromagnetic pump which improves a mounting efficiency of electronic parts.

It is still another object of the present invention to provide an electromagnetic pump which improves a vibration resistance of electronic parts.

It is still another object of the present invention to provide an electromagnetic pump which prevents a connection failure of electronic parts.

In order to achieve the above objects of the present invention, there is provided an electromagnetic pump comprising a sleeve member for housing a plunger for controlling an operation of a control valve, a resin coil bobbin, arranged around the sleeve member and having a pair of flanges, for winding an excitation coil, a ring-like printed circuit board stacked on an outer surface side of one flange of the coil bobbin with a predetermined interval therebetween and having a surface which faces the coil bobbin and on which various types of electronic parts are mounted, a ring-like holder stacked on a side of the printed circuit board opposite to the coil bobbin with a predetermined interval therebetween, a plurality of studs, projecting from the outer surface of the one flange of the coil bobbin and an inner surface of the holder, for integrally forming a stacked body, a pump housing for housing the stacked body integrally formed by the studs and the sleeve member in an assembled state, and a projecting portion projecting from a predetermined position on the outer surface of the one flange of the coil bobbin to apply an urging force to the various types of electronic parts mounted on the printed circuit board.

According to the present invention, the printed circuit board on which electronic parts and the like are vertically mounted is stacked and assembled together with the holder, the transistor, and the coil bobbin in the pump housing, and this assembly is housed in a pump housing, thereby facilitating assembly of the pump housing. In addition, a vibration resistance is assured because the projecting portion projecting from the flange of the bobbin urges the transistor against the circuit board or holds various types of electronic parts on the circuit board in a predetermined mounting attitude.

DETAILED DESCRIPTION OF THE PREFERRED EMBODIMENT

An embodiment of the present invention will be described below with reference to the accompanying drawings.

Figure 1:
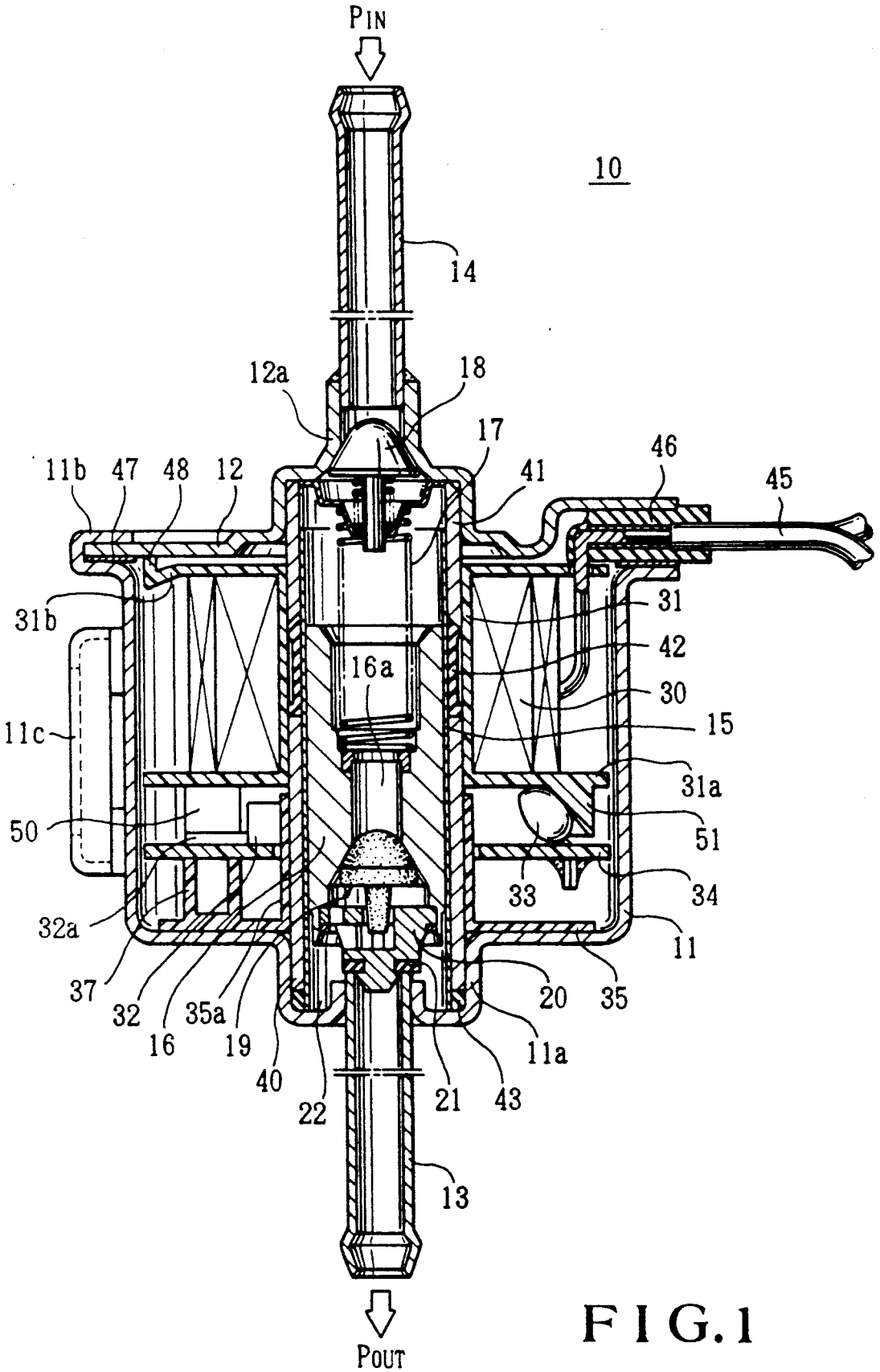
FIG. 1 is a longitudinal sectional view showing an embodiment of an electromagnetic pump according to the present invention.
Figure 2:
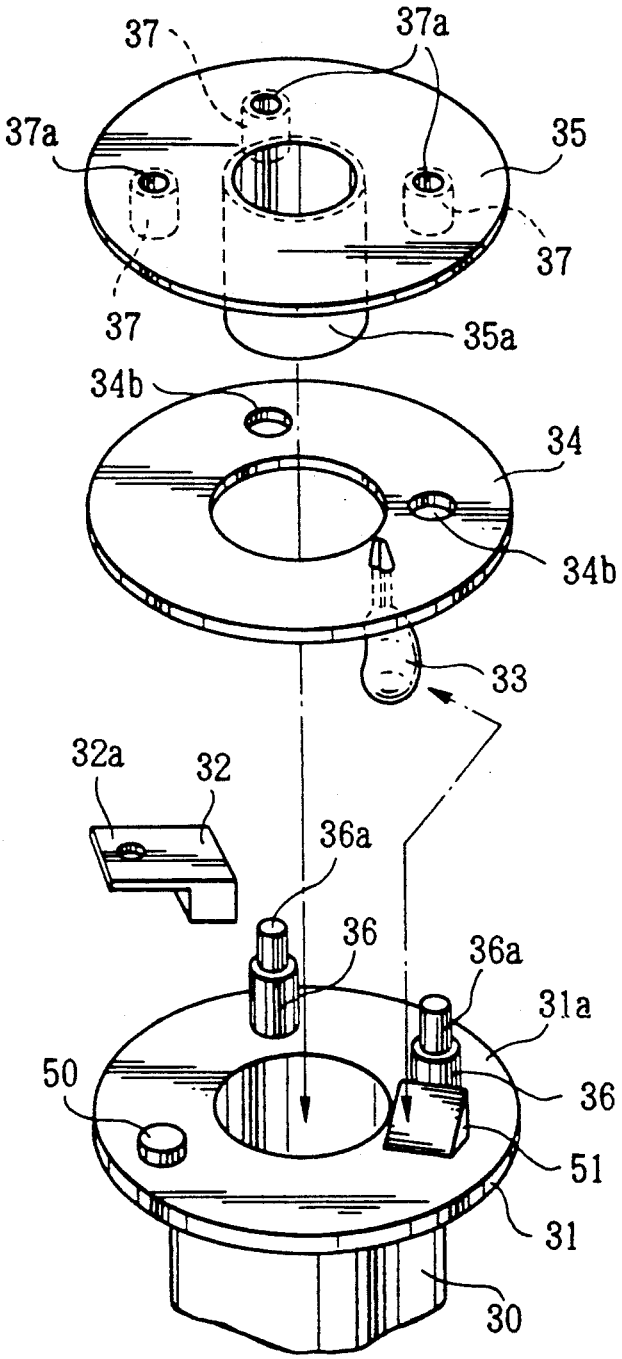
FIG. 2 is a schematic exploded perspective view showing pump constituting parts stacked in a pump housing as a main part of the electromagnetic pump shown in FIG. 1.
Figure 3:
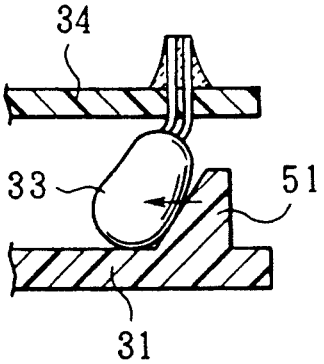
FIG. 3 is an enlarged sectional view showing a state in which electronic parts mounted on a printed circuit board are held by a projecting portion on the coil bobbin side.

FIGS. 1 to 3 show an embodiment of an electromagnetic pump according to the present invention. First, a schematic arrangement of an electromagnetic part generally denoted by reference numeral 10 will be briefly described with reference to FIG. 1. Referring to FIG. 1, reference numeral 11 denotes a cup-like housing main body constituting a pump housing; and 12, a disk-like cover member for closing the opening end of the housing main body 11. Cylindrical portions 11*a* and 12*a* are formed integrally with the central portion of the bottom of the main body 11 and with the central portion of the cover member 12, respectively, and extend outwardly. Pipe members 13 and 14 constituting fluid inlet and outlet ports are brazed to the centers of the cylindrical portions 11*a* and 12*a*, respectively. The main body 11 and the cover member 12 are easily formed from metal plates by pressing or the like and integrally assembled and fixed by caulking an opening end edge 11*b* on the main body side. The main body 11 and the cover member 12 constituting the pump housing also serve as a yoke for forming a flux path from an excitation coil (to be described later), and a space defined by the main body 11 and the cover member 12 serves as a housing space for arranging basic mechanical and electrical parts of the pump. Reference numeral 11*c* denotes a mounting bracket for fixing the pump 10 on the mounting side such as a vehicle.

Reference numeral 15 denotes a non-magnetic sleeve member held between the cylindrical portions 11*a* and 12*a* of the main body 11 and the cover member 12. A magnetic plunger 16 having a through hole 16*a* is slidably housed in the sleeve member 15 and normally biased toward the fluid outlet side by a return spring 17 arranged on the fluid inlet side.

Reference numeral 18 denotes a suction valve arranged at the end portion on the inlet side of the sleeve member 15; and 19, a discharge valve provided at the end portion on the outlet side of the plunger 16. A valve plug constituting the discharge valve 19 is slidably supported in a central cylindrical portion of a ring-like member 20 constituting a fluid leakage preventing control valve formed integrally with the end portion of the plunger 16. That is, the ring-like member 20 also serves to guide the valve plug of the discharge valve 19. A valve seat 21 consisting of rubber or a synthetic resin is provided at the distal end on the fluid outlet side of the cylindrical portion of the ring-like member 20. The valve seat 21 opens/closes the inner end of the fluid outlet side pipe member 13 extending on the fluid outlet side of the sleeve member 15 by a predetermined length. The fluid leakage preventing control valve integrally moves in the sleeve member 15 in accordance with the movement of the plunger 16 and closes, in its inoperative state, the inner end of the pipe member 13 by the effect of the return spring 17, thereby reliably preventing a leakage of a fluid to the outlet side. In addition, according to this embodiment, the inner end of the outlet side pipe member 13 is extended in the sleeve member 15 by a predetermined length so as to constitute the control valve described and to form an annular space 22, serving as a pulsation absorbing chamber for a discharge side fluid, around the pipe member 13.

A resin coil bobbin 31 obtained by winding an excitation coil 30 is arranged around the sleeve member 15 for housing the plunger 16 described above. A printed circuit board 34, on which a transistor 32 for constituting an oscillator for flowing an interrupted current to the excitation coil 30 and various types of electronic parts 33 such as a resistor, a diode, a transistor, a surge absorber, and capacitor are mounted, and a holder 35 for holding the printed circuit board 34 with a predetermined interval therebetween are sequentially stacked on the outer surface side of a flange 31*a* as one (below in the drawing) of flanges of the coil bobbin 31 in a direction perpendicular to the surface of the circuit board 34, as is apparent from FIGS. 1 and 2. This stacked body of the pump constituting parts is housed with the holder 35 as its distal end portion in the main body 11 constituting the pump housing so as to be housed between the main body 11 and the cover member 12 to be assembled with the main body 11.

As shown in FIG. 2, a plurality of (two in this embodiment), studs 36 project integrally from the outer surface of the flange 31*a* of the coil bobbin 31 to support the printed circuit board 34 on which the transistor 32 and the various types of electronic parts 33 are mounted. In addition, a plurality of (three in this embodiment) studs 37 project from the inner surface of the holder 35 at positions corresponding to the studs 36 and to a position at which the transistor 32 (to be described later) is to be assembled. Note that reference numeral 36*a* denotes a small-diameter portion at the distal end of each stud 36. The small-diameter portions 36*a* are fitted in holes 34*b* formed in the printed circuit board 34 to fix the circuit board 34 while regulating the movement in the surface direction of the circuit board 34. The small-diameter portions 36*a* are also fitted in holes 37*a* formed in the studs 37 of the holder 35 to integrally assemble the stacked body. Reference numeral 35*a* denotes a cylindrical portion projecting from the center of the holder 35.

In this embodiment, the printed circuit board 34 and the holder 35 are formed to have substantially a ring-like shape corresponding to the shape of the coil bobbin 31. Reference numerals 40 and 41 denote magnetic cylindrical members fitted between the outer circumferential surface of the sleeve member 15 housing the plunger 16 and the inner wall of the coil bobbin 31 from the two end portions of the sleeve member 15 and the coil bobbin 31. The cylindrical members 40 and 41 cause the plunger 16 to reciprocate by the excitation force of the excitation coil 30. The magnetic cylindrical member 41 on the cover member 12 side is brazed throughout the entire circumference thereof to the cover member 12 together with brazing of the pipe member 14 constituting the fluid inlet such that the outer end portion of the cylindrical member 41 is assembled inside the cylindrical portion 12*a* of the cover member 12, thereby maintaining the air-tightness. Reference numerals 42 and 43 denote sealing members for sealing a portion between the interior of the sleeve member 15 and the pump housing inner space; 45, a lead wire from the excitation coil 30 or the like formed by extracting a part of a junction portion between the housing main body 11 and the cover member 12 through a grommet 46; 47, a gasket for sealing a portion between the housing main body 11 and the cover member 12; and 48, engaging pieces formed at a plurality of positions on the outer circumferential edge of the other flange 31*b* of the coil bobbin 31 to serve as biasing means for elastically holding the stacked assembly housed in the pump housing. Other arrangements and an operation of the electromagnetic pump 10 are known to those skilled in the art and therefore a description thereof will be omitted.

According to the arrangement of the pump 10 described above, the transistor 32, the printed circuit board 34, and the holder 35 are sequentially assembled to the studs 36 projecting from the outer surface of the flange 31*a* of the coil bobbin 31 so as to be stacked with predetermined intervals therebetween by the studs 36 and 37. This stacked assembly is housed in the housing main body 11 so that the sleeve member 15 incorporated beforehand in the housing main body 11 is inserted through the central portion of the stacked assembly. The cover member 12 is placed on the housing main body 11, and the opening end edge 11*b* of the housing main body 11 is caulked to integrally assemble the entire structure.

According to the present invention, in the electromagnetic pump 10 having the above arrangement, when the resin coil bobbin 31 arranged around the sleeve member 15 for housing the plunger 16 to wind the excitation coil 30, the printed circuit board 34 which is stacked on the outer surface side of the flange 31*a* of the coil bobbin 31 with a predetermined interval therebetween and on which the various types of electronic parts 33 including the transistor 32 are mounted, and the holder 35 stacked outside the circuit board 34 with a predetermined interval therebetween are to be sequentially stacked and housed in the pump housing with predetermined intervals therebetween by the plurality of studs 36 and 37 projecting from the outer surface of the flange 31*a* of the bobbin 31 and the inner surface of the holder 35, projecting portions 50 and 51 are formed to project from the outer surface of the flange 31*a* of the bobbin 31 to apply an urging force to the electronic parts 33 including the transistor 32 placed or mounted on the printed circuit board 34, thereby holding the electronic parts (32 and 33) in predetermined positions.

The projecting portion 50 has an end face formed to have a flat surface and serves as an urging/fixing means for urging and holding a mounting piece 32*a* of the transistor 32 by the end face against the circuit board 34. The other projecting portion 51 has a holding surface formed to have an inclined surface and urges and holds sideways the electronic parts 33 soldered with their leads vertically inserted in the circuit board 34. Particularly, the projecting portion 51 can hold an electronic part vertically arranged with its leads vertically inserted in the circuit board while forcibly and automatically deforming the electronic part in the oblique direction upon assembly. Since the electronic part can be held in a predetermined attitude while a high vibration resistance is maintained, high assembly properties and high reliability in a connection portion of soldering can be assured, or the vibration resistance can be improved.

That is, regardless of the above simple arrangement, the pump 10 can be assembled very easily by preparing the printed circuit board 34 obtained by simply mounting the vertically arranged electronic parts 33, and stacking and assembling the circuit board 34 together with the holder 35, the transistor 32, and the coil bobbin 31. As a result, the workability especially in assembly of the circuit parts onto the circuit board 34 can be largely improved.

In addition, according to the present invention, since the necessary parts can be urged against the circuit board or stably held in predetermined attitudes by the projecting portions 50 and 51 formed integrally with the bobbin 31, the vibration resistance can be largely improved. For example, a stress acting on parts by an external stress such as a vibration can be reliably prevented. In addition, since the mounting attitude of the part can be displaced as described above, a problem of a connection failure caused when a soldered portion of lead wires to a circuit board is closed can be avoided. Therefore, the manufacturing cost can be reduced by an efficient mounting state on the circuit board 34 or an improvement in assembly efficiency.

Note that the present invention is not limited to the structure of the above embodiment but the shape, the structure, or the like of each part of the electromagnetic pump 10 can be arbitrarily changed and modified.

What is claimed is:

1. An electromagnetic pump comprising:

a sleeve member (15) for housing a plunger for controlling an operation of a control valve;

a resin coil bobbin (31), arranged around said sleeve member and having a pair of flanges, for winding an excitation coil;

an annular printed circuit board (34) stacked on an outer surface side of one flange of said coil bobbin with a predetermined interval therebetween and having a surface which faces said coil bobbin and on which various types of electronic parts are mounted;

an annular holder (35) stacked on a side of said printed circuit board opposite to said coil bobbin with a predetermined interval therebetween;

a plurality of studs (36), projecting from the outer surface of said one flange of said coil bobbin and an inner surface of said holder, for integrally forming a stacked body;

a pump housing (11, 12) for housing said stacked body integrally formed by said studs and said sleeve member in an assembled state; and a projecting portion (51) projecting from a predetermined position on the outer surface of said one flange of said coil bobbin to apply an urging force to said various types of electronic parts mounted on said printed circuit board, wherein said projecting portion has an inclined holding surface for urging and holding sideways an electronic part soldered to said printed circuit board with lead wires thereof vertically being inserted in said printed circuit board.

2. A pump according to claim 1, wherein said projecting portion has an urging holding surface for vertically urging and holding a mounting piece of an electronic part against said printed circuit board.

* * * * *